United States Patent [19]

Adams

[11] 4,119,046

[45] Oct. 10, 1978

[54] INCINERATION SYSTEM AND METHOD

[76] Inventor: Jack C. Adams, 4317 S. 32nd Rd., Arlington, Va. 22206

[21] Appl. No.: 713,532

[22] Filed: Aug. 11, 1976

[51] Int. Cl.[2] ..... F23G 5/12

[52] U.S. Cl. ..... 110/244; 110/297; 110/119

[58] Field of Search ..... 110/8 R, 8 C, 8 A, 28 J, 110/8 F, 28 F, 119

[56] References Cited

U.S. PATENT DOCUMENTS

| | | | |
|---|---|---|---|
| 3,685,467 | 8/1972 | Morrill | 110/8 |
| 3,745,940 | 7/1973 | Hibbett | 110/28 J |
| 3,771,469 | 11/1973 | Ali et al. | 110/8 |
| 3,785,302 | 1/1974 | Davis | 110/119 |
| 3,791,318 | 2/1974 | Oseroff et al. | 110/119 |
| 3,808,986 | 5/1974 | Logdon | 110/8 |

*Primary Examiner*—Kenneth W. Sprague
*Attorney, Agent, or Firm*—Frailey & Ratner

[57] ABSTRACT

An improved waste material incineration system and method of combustion where waste material is initially inserted through gravity assist into the combustion zone of a horizontally directed furnace. The waste material is impinged by the flame front of a burner and is cyclically vortexed in a vortexing zone of the combustion chamber through a combination of air inlet conduits impinging on the combusting waste material and the particular contouring of the furnace internal geometry. The waste material is initially densified in one section of the vortexing zone and then expanded in a second section of the vortexing zone while being impinged by inlet air to provide a guide to maintain the vortexing contour of the combusting waste material. During the expansion of the waste material in the second section of the vortexing zone, the substantially combusted waste material products are released into a heat release zone of the furnace while the non-combusted or partially combusted waste material is recirculated in the vortexing contour. The waste material is generally maintained within the vortexing zone of the combustion zone of the furnace until it is substantially combusted whereupon it is released during the expansion portion of the vortexing contour.

19 Claims, 2 Drawing Figures

INCINERATION SYSTEM AND METHOD

BACKGROUND OF THE INVENTION

1. Field of the Invention

This invention pertains to the field of incineration. In particular, this invention relates to incinerator systems and methods of combustion to provide for substantially total combustion of the waste material within a furnace.

2. Prior Art

Incinerator systems and incinerator methods of combustion are well known in the art. However, in some of the prior systems and methods of combustion, the waste material is merely impinged by the flame front of a burner. In such prior systems, the waste material is combusted in a highly inefficient manner. In some of these prior systems, the waste material even after it has been combusted is still impinged by the flame front. This has the effect in some cases of providing an insulation base for the non-combusted material contained within the furnace and thus more fuel must be utilized in fully combusting the waste material.

Additionally, in some prior incineration systems, the waste material is inserted into the furnace and then impinged by a flame front for a predetermined time which is empirically derived. In some cases this has resulted in a large quantity of the waste material not being fully combusted during the incineration process. Thus, large quantities of non-combusted waste material is found in the products of the incineration process and such must be in some way disposed of or recombusted in the incinerator leading to an inefficient and uneconomical process.

In some prior systems, the waste material is vortexed during the combustion process. However, in some such prior incineration systems, the waste material is merely vortexed and then removed. Such systems do not provide for a revortexing or recirculation of the combusting waste materials until they are substantially fully combusted. Thus, in such prior systems, there is the distinct possibility that non-combusted waste materials are found in the end products of the incineration systems.

In other prior incineration systems, the waste materials are vortexed for a predetermined interval of time wherein they may or may not be combusted fully. In such prior systems, the vortexing procedure is directed to a time interval and not directed to the primary purpose of maintaining the waste material in a combustion zone until it is fully or substantially fully combusted. Thus, where various waste materials have different combustion times, such products of combustion are found to have large amounts of non-combusted material.

SUMMARY OF THE INVENTION

A waste material incineration method within a horizontally directed furnace which initially includes the step of inserting waste material into a combustion zone of the furnace in a direction substantially normal to the horizontal direction. The waste material is vortexed in the combustion zone and forms a waste material vortexing zone. The waste material is densified in a first section of the vortexing zone. The first section has a diminishing cross-sectional area in a direction coincident with a first displacement path of the waste material in the first section. The waste material is then expanded in a second section which has an expanding cross-sectional area in a direction coincident with the second displacement path. A first portion of the waste material is maintained in the combustion vortexing zone prior to substantially complete combustion.

DESCRIPTION OF THE PREFERRED EMBODIMENTS

Figure 1:
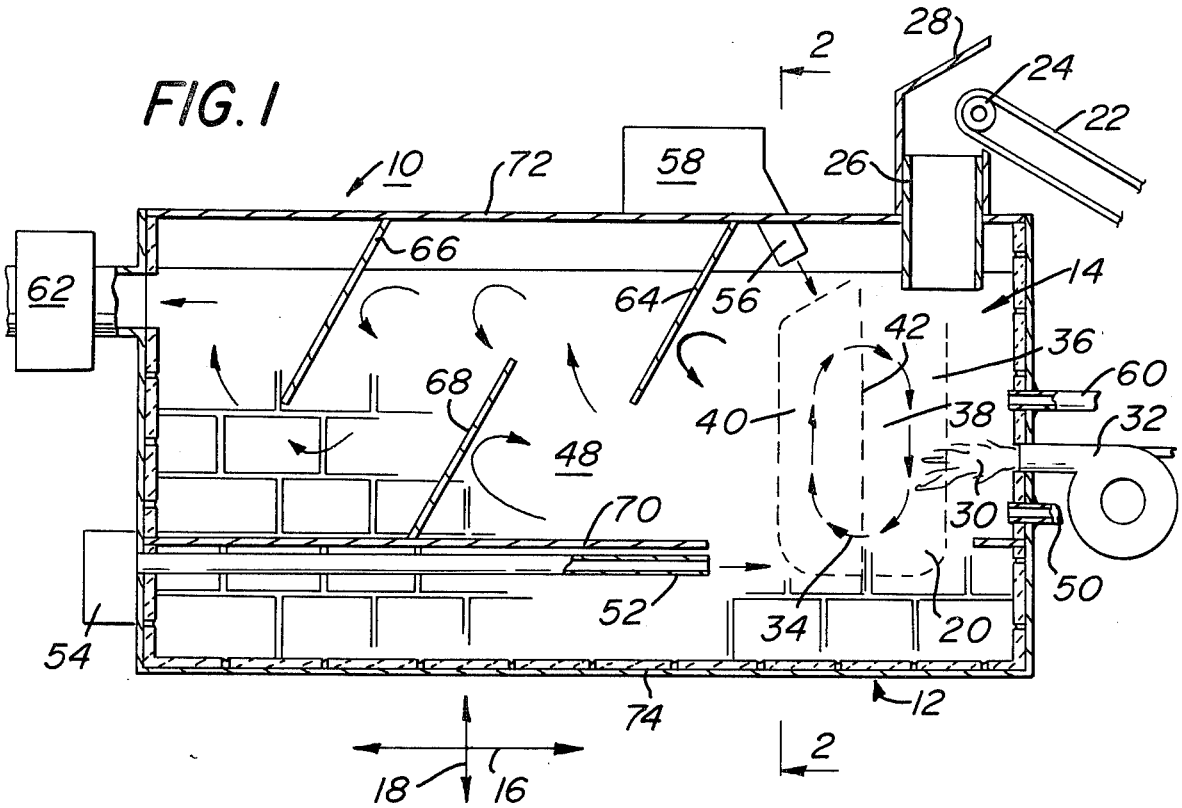
FIG. 1 is an elevation cut-away view of the incinerator system showing the vortexing contour of the waste material as it combusted.
Figure 2:
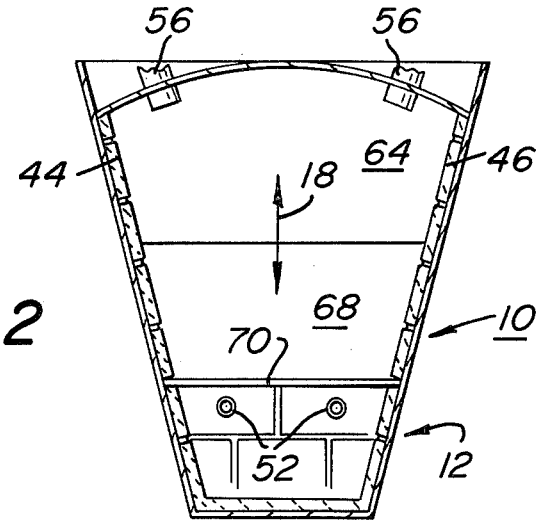
FIG. 2 is a sectional view of the incinerator system taken along the sectional lines 2—2 of FIG. 1.

Referring now to FIGS. 1 and 2, there is shown waste material incineration system 10 for use in combusting and disposing of waste material inserted therein. In overall concept, waste material incineration system 10 utilizes geometrical contour properties of horizontally directed furnace 12 in combination with air inlet devices to increase the time of the inserted waste material within a combustion zone of furnace 12.

Additionally, there is provided by system 10, a separation of the waste material being combusted into a first and second portion where the second portion having been fully combusted is removed from the combustion zone of furnace 12. It has been found that the substantially unburned or combusted portion of the inserted waste material is maintained within the combustion zone of furnace 12 until the waste material is substantially combusted. This has the effect of providing for a maximally efficient incineration system 10 and further provides for a high heat of combustion.

In totality, and as will be shown in following paragraphs, waste material is inserted into combustion zone 14 of furnace 12. Furnace 12 is generally a horizontally directed furnace where the horizontal direction is defined by horizontal arrow 16 as provided in FIG. 1. The waste material is inserted in a direction which is defined by vertical directional arrow 18 into combustion zone 14. Once within combustion zone 14, the waste material is vortexed in a particular closed contour manner to be fully discussed in following paragraphs and forms vortexing zone 20 within combustion zone 14. During the combustion process, a first portion of the waste material is maintained in the combustion vortexing zone 20 prior to the substantially complete combustion of that portion of the waste material.

Initially, waste material is brought to horizontally directed furnace 12 through endless conveyor 22 as is shown in FIG. 1. Actuation of conveyor 22 is provided by a plurality of pulleys 24, one of which is shown in FIG. 1. The waste material is shredded or otherwise reduced to particle sizes having a maximum length in the area of 3 inches. The shredding device not shown, reduces the waste material particles to the appropriate size lengths and may be one of many different types such as a hammer-type mill, one of which is provided by the Bryant-Poff Corporation having a designation of Model No. 50X36 Big-Pro Shredder or some like shredding device which is not important to the inventive concept as is herein detailed.

The waste material now having a size nominally less than three inches in length is carried on conveyor 22 and through gravity assist is inserted into furnace insert conduit 26. Cover member 28 is provided at the upper wall of furnace 12 in order to provide a guide for the waste material and insure that such is inserted into conduit 26. Conduit 26, since it passes partially into combustion zone 14 is generally formed of a heat resistant material such as a silicon carbide material. The waste material enters combustion zone 14 by gravity assist and is thus initially directed into an intersecting path with flame front 30 of burner 32. Burner 32 may be an oil burner or a gas burner not important to the inventive concept as is herein described. The important consideration being that flame front 30 impinge on the waste material being inserted by gravity assist through furnace insert conduit 26 as is shown in FIG. 1.

Through a combination of air inlet devices and geometrical considerations of the furnace 12, the waste material is formed into a vortexing pattern defined by clockwise rotational arrows 34. The vortexing pattern has been found to provide for a vortexing zone 36 within combustion zone 14 and is defined in FIG. 1 by the dashed lines surrounding rotational arrows 34. For purposes of further clarification in following paragraphs, vortexing zone 36 in itself is divided into first section 38 and second section 40 where those sections are abstractly divided by center dashed line 42 which is imaginary, but is herein shown for purposes of clarification in later paragraphs of the description of the flow of the waste material within combustion zone 14, and more specifically within vortexing zone 20.

Horizontally directed furnace 12 has a predetermined cross-sectional area contour in a plane normal to a horizontal direction 16 as is shown in FIG. 2. As is seen, the cross-sectional contour is monitonically decreased as the waste material initially passes in a downward manner in vertical direction 18. As shown by FIG. 2, the cross-sectional area is trapezoidal in contour and thus combustion zone 14 is substantially a trapezoidal cylinder. This contouring of the cross-sectional area of furnace 12 is important in the vortexing of the waste material being combusted within combustion zone 14.

As waste material passes through gravity assist in vertical direction 18 through conduit 26, it is seen to enter combustion zone 14 of furnace 12. More in particular, the waste material enters into vortexing zone first section 38 where it is impinged by flame front 30 of burner 32. However, passage of waste material into first section 38 has been found to have another effect on the entering waste material. This occurs due to the fact that the waste material is forced together in a manner defined by the rigid contour of the opposing inclined sidewalls 44, 46 of furnace 12. This has the effect of densifying the waste material in vortexing zone first section 38. The burning and combusted waste material is passed in clockwise direction 34 from first section 38 to vortexing zone second section 40. As will be clearly seen from FIG. 1, the burning and combusted waste material is now passing in an upward direction as defined by vertically directed arrows 18. However, in vortexing zone section 40, the burning and combusted waste material is now expanding due to the inclined walls 44, 46 which allow for a greater cross-sectional area as the burning products are moved upwardly within second section 40. Rotational characteristics to the burning waste material are maintained by various air inlet devices which will be described in following paragraphs.

The waste material is therefore densified by directing such in a path of initially decreasing cross-sectional area within vortexing first section 38 of combustion 14 and then by further directing the waste material in a path of increasing cross-sectional area within vortexing zone second section 40 of combustion zone 14 while maintaining a guide to provide a closed contour path for the combusting waste material.

What has been unexpectedly found in the operation of incinerator system 10 is that the non-combusted waste material as well as the partially combusted waste material is generally maintained within vortexing zone 36 in the cyclical path defined by clockwise rotational arrows 34. This defines a first portion of the waste material which is maintained within combustion zone 14 for a time which allows for full or substantially complete combustion. What has further been observed is that a second portion of the waste material which is either fully or substantially fully combusted is released from vortexing zone 36 to pass into contiguous heat release zone 48 of furnace 12.

The reason that this occurs is not fully understood, however, it is believed that the initial densifying of the waste material as it passes downwardly in first section 38 of vortexing zone 36 in combination with the expanding of the waste material as it passes in the upward direction in second section 40 has a nozzle-like effect on the waste material. Thus, as the waste material passes upwardly in second section 40, the unburned or partially combusted particles would have a higher momentum value than the burned or substantially fully combusted particles of the waste material. This momentum would be effected more by the guide air inputs and possibly the burned gases would expand at a quicker rate and be released into heat release zone 48 in an optimized fashion whereas the partially combusted waste material would be maintained in the cyclical contour within vortexing zone 36.

Directionality is given to the waste material within vortexing zone by a plurality of air inlet devices. These air inlet devices provide for both the directionality characteristics of the waste material as well as possibly providing additional air for maximizing the combustional process. Initially, the waste material is directionally activated merely by gravity assist as it passes through insert conduit 26. After passing in downward direction defined by vertical arrow 18, passed flame front 30, the waste material is impinged by a stream of air passing through air insert device 50 which is located as is seen in FIG. 1 at a point substantially near the bottom of the closed contour trajectory of the waste material within vortexing zone 36. Air pressure passing through air insert conduit 50 has been found to be successfully actuating over a rather wide pressure range and has been sucessfully utilized in the range of 1–6 psia. In actual practice, the air insert pressure is generally maintained at approximately 4.0 psia.

As the now combusting waste material is passed into second section 40, it is actuated on by a low pressure inlet conduit 52 which brings air into furnace 12 from plenum 54 positioned external to furnace 12 as is shown in FIG. 1. Conduit 52 since it enters into both heat release zone 48 and combustion zone 14 is generally formed of a silicon carbide material.

Air insertion through conduit 52 is maintained in a pressure of approximately 1.5–4.0 psia. As is seen, the air insert through conduit 52 opposingly strikes the combusting waste material as it passes from first section 38 to second section 40 of vortexing zone 36. This has the effect of giving the combusting waste material a force direction in an upward manner in order that the waste material may be guided into an expansion phase as has hereinbefore been described. As the burning waste material passes upwardly in second section 40, it is impinged at an uppermost contour path by further air being inserted through upper air conduit 56 supplied by plenum 58 mounted on an upper wall of furnace 12.

Upper air conduit 56 provides for air to be inserted into vortexing zone 36 at an acute angle with respect to the upper wall of furnace 12 and has the effect of continually directing the waste material in the closed contour path.

Thus, there has been shown the mechanisms for vortexing the waste material within the vortexing zones and such include the plurality of air inlets 50, 52 and 56 which are adapted to impinge the waste material within combustion zone 14 and generally aid in directing the waste material in the vortexing path as defined by the clockwise rotational arrows 34. It will be noted that additional air may be supplied by air insert conduit 60, however, such is not generally used for directional properties, but would be used to provide additional air for combustion purposes.

The mechanism for removing the second portion of the waste material from combustion zone 14 subsequent to the substantially complete combustion of that portion of the waste material within the zone 14 includes induction fan 62 mounted external to furnace 12. Induction fan 62 has been found to provide an operable condition when drawing approximately 2 inches of water pressure. Induction fan 62 provides for an aid in releasing and attracting the second portion of the waste material through heat release zone 48 of furnace 12 after it has been released from vortexing zone 36.

Silicon carbide baffles are connected to the inner walls of furnace 12 extended internal to heat release zone 48 in the manner as shown in FIG. 1. Silicon carbide baffles 64, 66 and 68 may be in the form of trapezoidal plates and generally provide for a tortuous path for the substantially burned waste material as it passes through heat release zone 48 to induction fan 62. Plates 64, 66 and 68 also provide a mechanism whereby the unburned hydrocarbons impinge on a hot surface and dissipate to provide for substantially full combustion of any partially combusted material which is passing through heat release zone 48.

It will be noted that plate or baffle 68 is secured to floor member 70 which passes partially throughout a horizontal length of furnace 12. Floor member 70 covers low pressure conduits 52 and extends substantially throughout the horizontal length of low pressure conduits 52 as is shown in FIG. 1. Lower baffle 68 is secured to both floor member 70 and opposing side walls of the furnace 12 through bolting, bracket securement or some like mechanism not important to the invention much in the same manner as the plate baffles 64 and 66 are mounted to the upper walls and sidewalls of the furnace 12.

Inclined side walls 44 and 46 as well as upper and lower wall members 72 and 74 of furnace 12, are generally formed of an internal layer of fire brick and include a one inch thick Fiber Frax felt lining manufactured by Union Carbide Corporation, to provide sufficient heat resistance to combusting material within furnace 12. However, the particular type of structure of incineration system 10 and the particular materials utilized therein are not important to the inventive concept as herein defined with the exception that such have a sufficiently low conductivity that the external surroundings are not effected by the heat release within furnace 12 as well as not being derrogatorily effected by the high heat release within combustion zone 14.

What is claimed is:

1. A waste material incineration method within a horizontally directed furnace, including the steps of:

(a) inserting waste material into a combustion zone of said furnace in a direction substantially normal to said horizontal direction;

(b) vortexing said waste material in said combustion zone to form a vortexing zone;

(c) densifying said waste material in a first section of said vortexing zone, having a diminishing cross-sectional area in a direction coincident with a first displacement path of said waste material in said first section; and, (d) expanding said waste material in a second section of said vortexing zone having an expanding cross-sectional area in a direction coincident with a second displacement path of said waste material in said second section, a first portion of said waste material being maintained in said vortexing zone prior to substantially complete combustion.

2. The waste material incineration method as recited in claim 1 where the step of densifying includes the step of directing said waste material in a path of decreasing cross-sectional area within said combustion zone.

3. The waste material incineration method as recited in claim 2 where the step of directing said waste material includes the step of combusting said waste material in said first section of said vortexing zone.

4. The waste material incineration method as recited in claim 3 where the step of combusting includes the step of impinging said waste material with a flame front directed substantially normal to said path of said waste material in said first section of said vortexing zone.

5. The waste material incineration method as recited in claim 1 where the step of densifying includes the step of driving said waste material in said first section through gravity assist.

6. The waste material incineration method as recited in claim 1 where the step of expanding includes the step of directing said waste material in a path of increasing cross-sectional area within said combustion zone.

7. The waste material incineration method as recited in claim 6 where the step of directing said waste material includes the step of forcing said waste material in a direction substantially opposed to a gravity vector.

8. The waste material incineration method as recited in claim 1 where the step of expanding includes the step of releasing a second portion of said waste material from said vortexing zone, said second portion of said waste material being substantially fully combusted.

9. The waste material incineration method as recited in claim 1 where the step of maintaining a first portion of said waste material in said vortexing zone is followed by the step of attracting a second portion of said waste material to a heat release zone contiguous said combustion zone of said furnace.

10. The waste material incineration method as recited in claim 9 where the step of attracting includes the step of establishing a pressure differential from said combustion zone to said heat release zone.

11. The waste material incineration method as recited in claim 1 where the step of vortexing includes the step of inserting air into said combustion zone for impingement of said waste material in a manner to form a vortexing contour.

12. A waste material incineration system comprising:

(a) a horizontally directed furnace having a predetermined cross-sectional area contour in a plane normal to said horizontal direction;

(b) means for vortexing said waste material within a combustion zone of said furnace, said furnace having a diminishing cross-sectional path of said waste material in a first section of said vortexing zone and an expanding cross-sectional area in a direction coincident with a second displacement path of said waste material in a second section of said vortexing zone, said displacement paths being in a direction substantially normal to said horizontal direction; and, (c) means for removing a second portion of said waste material from said combustion zone subsequent to substantially complete combustion of said waste material in said combustion zone.

13. The waste material incineration system as recited in claim 12 where said cross-sectional area contour is monotonically decreased in said first section of a vortexing zone within said combustion zone.

14. The waste material incineration system as recited in claim 12 where said cross-sectional area is trapezoidal in contour.

15. The waste material incineration system as recited in claim 12 where said combustion zone is substantially a trapezoidal cylinder.

16. The waste material incineration system as recited in claim 12 where said means for vortexing includes a plurality of air inlets adapted to impinge said waste material within said combustion chamber for directing said waste material in a vortexing path.

17. The waste material incineration system as recited in claim 16 where said waste material is cyclically vortexed through a decreasing and increasing cross-sectional area of said combustion chamber.

18. The waste material incineration system as recited in claim 12 where said means for removing said second portion of said waste material includes induction fan means for displacing said second portions of said waste material to a heat release zone within said furnace.

19. The waste material incineration system as recited in claim 18 where said means for removal includes baffle means secured to an inner surface of said furnace, said baffle means being positioned within said heat release zone of said furnace.

* * * * *